US011434648B2

(12) United States Patent
Tawil

(10) Patent No.: US 11,434,648 B2
(45) Date of Patent: Sep. 6, 2022

(54) METHOD AND DEVICE FOR CUTTING CUSTOM-SIZED TILES

(71) Applicant: Julio Tawil, Atlanta, GA (US)

(72) Inventor: Julio Tawil, Atlanta, GA (US)

( * ) Notice: Subject to any disclaimer, the term of this patent is extended or adjusted under 35 U.S.C. 154(b) by 856 days.

(21) Appl. No.: 16/291,962

(22) Filed: Mar. 4, 2019

(65) Prior Publication Data

US 2020/0284052 A1 Sep. 10, 2020

(51) Int. Cl.

| | |
|---|---|
| ***E04F 21/00*** | (2006.01) |
| ***E04F 21/22*** | (2006.01) |
| ***B28D 1/22*** | (2006.01) |
| ***E04D 15/02*** | (2006.01) |

(52) U.S. Cl.

CPC ..... *E04F 21/0076* (2013.01); *B28D 1/225* (2013.01); *E04D 15/025* (2013.01); *E04F 21/22* (2013.01)

(58) Field of Classification Search

CPC ..... E04F 21/0076; E04F 21/20; E04F 21/22; B28D 1/225; E04D 15/025; B25H 7/02; B43L 7/12; G01B 3/56; G01B 3/566

USPC ..... 33/471, 526, 527; 52/747.11, 749.11

See application file for complete search history.

(56) References Cited

U.S. PATENT DOCUMENTS 941,313 A * 11/1909 Easley et al. ..... B43L 7/14 33/DIG. 16
1,585,563 A * 5/1926 Schlattau ..... G01B 3/00 33/471
1,635,874 A * 7/1927 Wynkoop ..... G01B 3/56 33/473
4,813,149 A * 3/1989 Herkimer ..... B25H 7/00 D10/69
5,375,334 A * 12/1994 Coker ..... E04F 21/0023 33/194
5,701,680 A * 12/1997 Garcia ..... E04F 21/20 33/526
6,708,422 B1 * 3/2004 Stojanovski ..... B23Q 9/005 33/640
7,073,267 B2 * 7/2006 Butler ..... G01B 3/20 33/203.18

(Continued)

FOREIGN PATENT DOCUMENTS

CA 2414561 A1 * 6/2004 ..... B25H 7/02
CN 110039667 A * 7/2019

(Continued)

*Primary Examiner* — Ryan D Kwiecinski
(74) *Attorney, Agent, or Firm* — BakerHostetler

(57) ABSTRACT

A device for use in creating custom tiles for installation adjacent an angled vertical surface is disclosed. An example device includes first and second elongated members coupled via a hinge configured to selectively prevent pivoting at the hinge. The device further includes a slide piece coupled to the first member and configured to slide lengthwise along the first member. The slide piece may be selectively operated to prevent movement along the first member. The slide piece may further include a body. The body may comprise a longitudinal alignment element and a perpendicular lateral alignment element that together define a recess configured to receive a corner of an installed tile. The body may further include a spacer configured to selectively extend from or retract into the body. The spacer and the lateral alignment element may define a space therebetween.

20 Claims, 11 Drawing Sheets

(56) References Cited

U.S. PATENT DOCUMENTS

| | | | | |
|---|---|---|---|---|
| 7,254,898 | B1 * | 8/2007 | Armstrong | B43L 7/10 33/421 |
| 7,694,670 | B2 * | 4/2010 | Smith | B28D 1/225 125/23.01 |
| 10,866,077 | B1 * | 12/2020 | Dolejs, III | G01B 3/002 |
| 11,267,120 | B2 * | 3/2022 | Garcia | B25H 7/045 |
| 2003/0033724 | A1 * | 2/2003 | Barbosa | E04F 21/0076 33/526 |
| 2004/0060183 | A1 * | 4/2004 | Moas | E04F 21/20 33/526 |

FOREIGN PATENT DOCUMENTS

| | | | | | |
|---|---|---|---|---|---|
| CN | 113123577 | A | * | 7/2021 | |
| DE | 4333757 | A1 | * | 6/1994 | B28D 1/225 |
| DE | 10246237 | A1 | * | 4/2004 | E04F 21/0092 |
| DE | 202013000258 | U1 | * | 5/2013 | E04F 21/0076 |
| FR | 2979366 | A1 | * | 3/2013 | B25H 7/02 |
| GB | 2185115 | A | * | 7/1987 | B23Q 35/44 |
| GB | 2574694 | A | * | 12/2019 | B25H 7/005 |

* cited by examiner

METHOD AND DEVICE FOR CUTTING CUSTOM-SIZED TILES

TECHNICAL FIELD

This disclosure generally relates to tile laying and, in particular, a method and device for cutting custom-sized tiles for installation adjacent an angled vertical surface.

BACKGROUND

Laying floor tiles is a time consuming task, but also one requiring precise measurement and close attention to detail. When laying tile in a room, a worker typically begins by laying (i.e., installing) uncut tiles in the central areas of the room. At the peripheries of the room, however, an uncut tile is most likely too large to exactly fit within the space left between adjacent uncut tiles and a wall or other vertical surface. What's more, a wall may be at an irregular angle with respect to the laid tiles. For example, a wall may be oriented at an angle such that no side of a square or rectangular tile would be parallel to the wall if the tile were installed. The irregular angle of a wall may be an intentional aspect of the room's design or an unintended consequence of hurried construction or shifts in a building's structure.

To adjust for the irregular angle of the wall, a worker typically attempts to cut a custom tile such that the appropriate side of the tile is angled to match the angle of the wall once the tile is installed. Producing the custom tile may often involve taking measurements at various intervals between the wall and the back edge of the tile. These measurements are generally taken with a measuring tape and thus are subject to the potential imprecisions and inaccuracies involved in their use. Further, creating a custom tile may degrade into a time consuming trial-and-error process in which a worker initially takes measurements and writes them down, moves to a tile cutting station, cuts the tile according to the measurements, and moves back to the tile placement location. In many cases, the cut tile does not fit as expected. The worker must then take the tile back to the cutting station, further cut the tile (or start over on a new tile), and repeat the process until the tile has the proper dimensions and angles for the placement.

At times, floor tiles may be installed in a room with baseboards at the junction of the floor and walls. In this case, some imprecision may be tolerated since the baseboard typically is installed on top of the edges of the tile. The above-noted difficulties, however, are compounded when a project requires that grout be installed between the outer tiles and the wall or other vertical surface. For example, the floor tiles in a bathroom are often expected to nearly abut against the vertical surface of wall tiles, with grout or other sealant being installed therebetween to create a water-tight seal. In this case, any misalignment of the edge of the tile to the wall is plainly evident and creates a poor visual impression.

These and other shortcomings are addressed in the present disclosure.

SUMMARY

Disclosed herein are a device for use in creating a custom tile to be installed in an irregular space adjacent an angled wall or other vertical surface. An example device includes an elongated first member and an elongated second member that is pivotally connected to the first member via a hinge. The hinge is configured to selectively prevent or enable pivoting of the first member and the second member at the hinge. The device includes a slide piece that is slidingly coupled to the first member. The slide piece is configured to selectively prevent or enable movement of the slide piece lengthwise along the first member. The slide piece comprises a body. The body comprises a longitudinal alignment element that extends parallel to the longitudinal axis of the body. The body further comprises a lateral alignment element arranged perpendicular to the longitudinal alignment element. The longitudinal alignment element and the lateral alignment element together define a recess at a bottom portion of the body. The recess is configured to receive a corner of a tile. The body further comprises a spacer configured to selectively extend from or retract into the body. The spacer comprising a second lateral alignment element that is parallel to the first lateral alignment element of the body. The first lateral alignment element of the body and the second lateral alignment element of the spacer define a space therebetween when the spacer is at least partially extended from the body.

Said device may be used in an example method to determine a cut angle and a cut dimension for an uncut custom tile that is to be installed between an installed tile and a fixed vertical surface oriented at an irregular angle with respect to the installed tile. The example method includes positioning the second member to abut the fixed vertical surface. The first member is positioned parallel to a side edge of the installed tile. While the second member abuts the fixed vertical surface and the first member is parallel to the side edge of the installed tile, the hinge is operated to prevent the first member and the second member from pivoting relative to one another. An angle between the first member and the second member comprises the cut angle. Further while the second member abuts the fixed vertical surface and the first member is parallel to the side edge of the installed tile, the device and the slide piece are positioned such that a corner of the installed tile, defined in part by the side edge of the installed tile, occupies the first recess and abuts both the first longitudinal alignment element of the body and the first lateral alignment element of the body. The cut dimension for the custom tile comprises a distance between the second lateral alignment element of the spacer and a distal end of the first member at the hinge.

BRIEF DESCRIPTION OF DRAWINGS

The accompanying drawings, which are incorporated in and constitute a part of this specification, illustrate embodiments and together with the description, serve to explain the principles of the methods and systems.

Aspects of the disclosure will now be described in detail with reference to the drawings, wherein like reference numbers refer to like elements throughout, unless specified otherwise.

DETAILED DESCRIPTION

Figure 1:
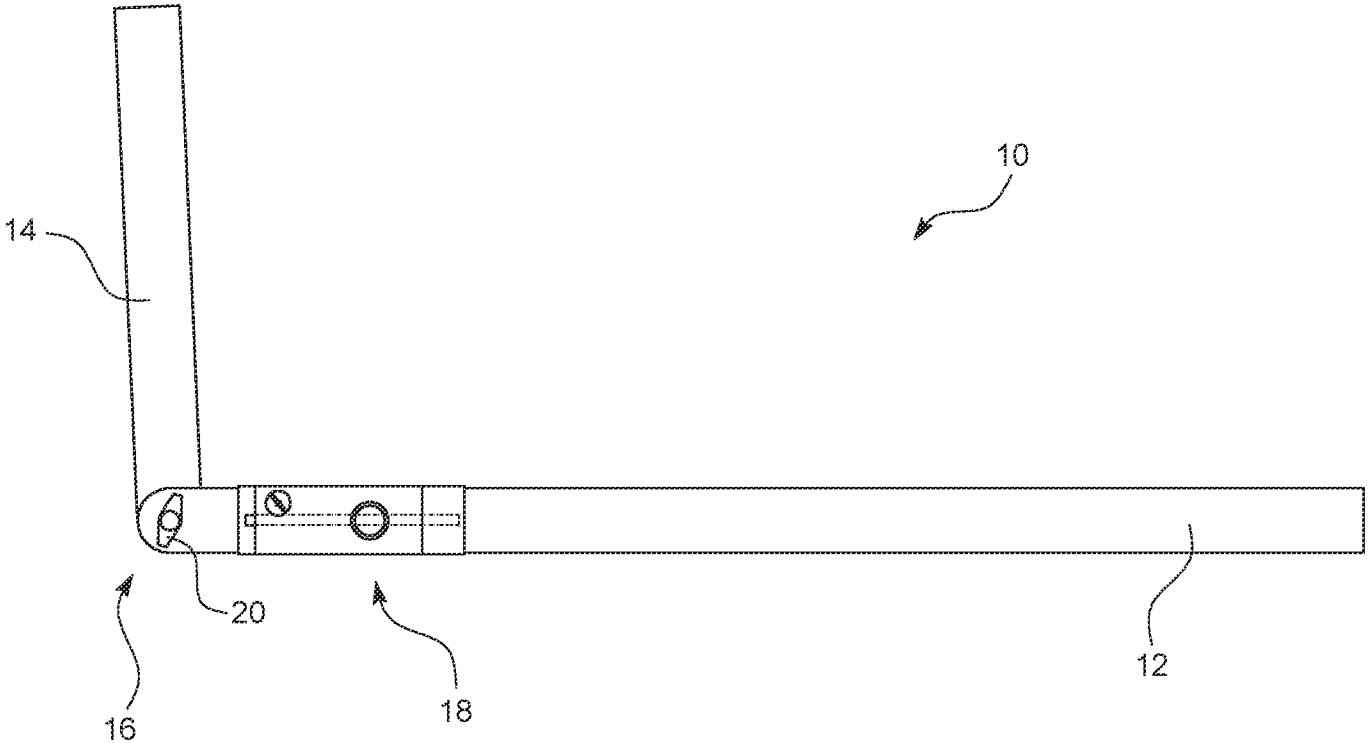
FIG. 1 provides a top-down view of the disclosed device according to an embodiment of the present disclosure.

The present disclosure relates to a device configured to aid in laying floor tile or other similar material, such as linoleum squares or even wall or ceiling coverings. The present disclosure further relates to methods of using said device to lay tile. As examples, the disclosed device facilitates measuring one or more tile dimensions useful for installing a tile abutting a vertical surface, such as a wall, in particular a wall positioned at an irregular angle (e.g., not horizontally perpendicular) relative to the orientation of tiles already installed within the space. The disclosed device further facilitates determining one or more angles according to which a custom tile is preferably cut for installation at the angled vertical surface. Additionally, the disclosed device facilitates cutting tile according to the determined one or more cut dimensions and one or more cut angles.

Reference is made herein to the attached drawings. Like reference numerals throughout the drawings shall refer to same or similar components or features unless clearly indicated otherwise by express statement or context.

FIG. 1 provides a top-down view of a disclosed device 10 for use in laying tile. Said device 10 comprises an elongated first member 12 and an elongated second member 14 coupled to one another in a pivoting relationship. For example, a proximate (e.g., nearer the pivot point) end portion of the first member 12 and a proximate end portion of the second member 14 are pivotally coupled by a hinge 16. The hinge 16 (or the pivot point generally) may be configured such that an operator is able to selectively adjust the force required to pivot the first member 12 and/or the second member 14. For example, the hinge 16 may be configured so that the operator can manually adjust the hinge 16 to allow for easy, but controlled, pivoting. The hinge 16 may be also configured so that the operator can manually adjust the hinge 16 to inhibit or prevent pivoting. That is, the hinge 16 is configured to be selectively lock or unlocked—a lockable hinge. For instance, the operator may adjust the hinge 16 so that an angle between the first member 12 and the second member 14 is held fixed, in particular between the steps of aligning the device 10 against a wall and positioning the device 10 at an uncut tile to determine a cutline. In the embodiment shown in FIG. 1 and the other figures, the hinge 16 comprises a wingnut 20 and bolt passing through the proximate end portions of the first member 12 and the second member 14, respectively (see also FIGS. 2 and 3). The wingnut 20 may be loosened to progressively allow pivoting at the hinge 16. Conversely, the wingnut 20 may be tightened to progressively inhibit or prevent pivoting at the hinge 16. A thumbscrew or the like may be used in place of the wingnut 20. In some embodiments, the hinge 16 may be configured such that it is pivot-able under manual effort yet still maintains the selected angle for the contemplated uses described herein.

The first member 12 is configured with a slide piece 18 that is selectively movable lengthwise along the first member 12 (i.e., along the longitudinal axis of the first member 12). As will be described further herein, the slide piece 18 is configured with a hollow through which the first member 12 passes. The hollow of the slide piece 18 is sized so that the first member 12 is generally free from movement or "play" within the slide piece 18 except for the lengthwise movement of the slide piece 18 along the first member 12. The slide piece 18 is configured to selectively limit or prevent its movement along the first member 12. For example, the position of the slide piece 18 on the first member 12 may be frozen, in conjunction with the angular position of the first member 12 and the second member 14 also being frozen, as part of the disclosed tile preparation process.

The first member 12 and the second member 14 are inscribed as rulers, but, as the disclosure will make clear, such ruler inscriptions are not necessary for effective use of the device 10. Indeed, the device 10 and disclosed methods of use largely do away with the need for a ruler or other measuring device while cutting custom-fitted edge tiles. The first member 12 is configured with a greater length than the second member 14, but the disclosure is not so limited. The slide piece 18 may be removed from (e.g., slid off of) the first member 12 and slid onto the second member 14 to better accommodate various tile/wall configurations and workspaces. The second member 14 is generally sized so as to at least span the width of a tile while marking a cutline on the tile. By doing so, the operator need only make a single swipe or motion with a pencil or the like to mark the cutline. The first member 12 and the second member 14, and indeed the device 10 as a whole, may be sized according to contemplated uses. For example, a bathroom installation may use smaller tiles than those used in a commercial space installation, and the device 10 may be sized accordingly.

Figure 2:
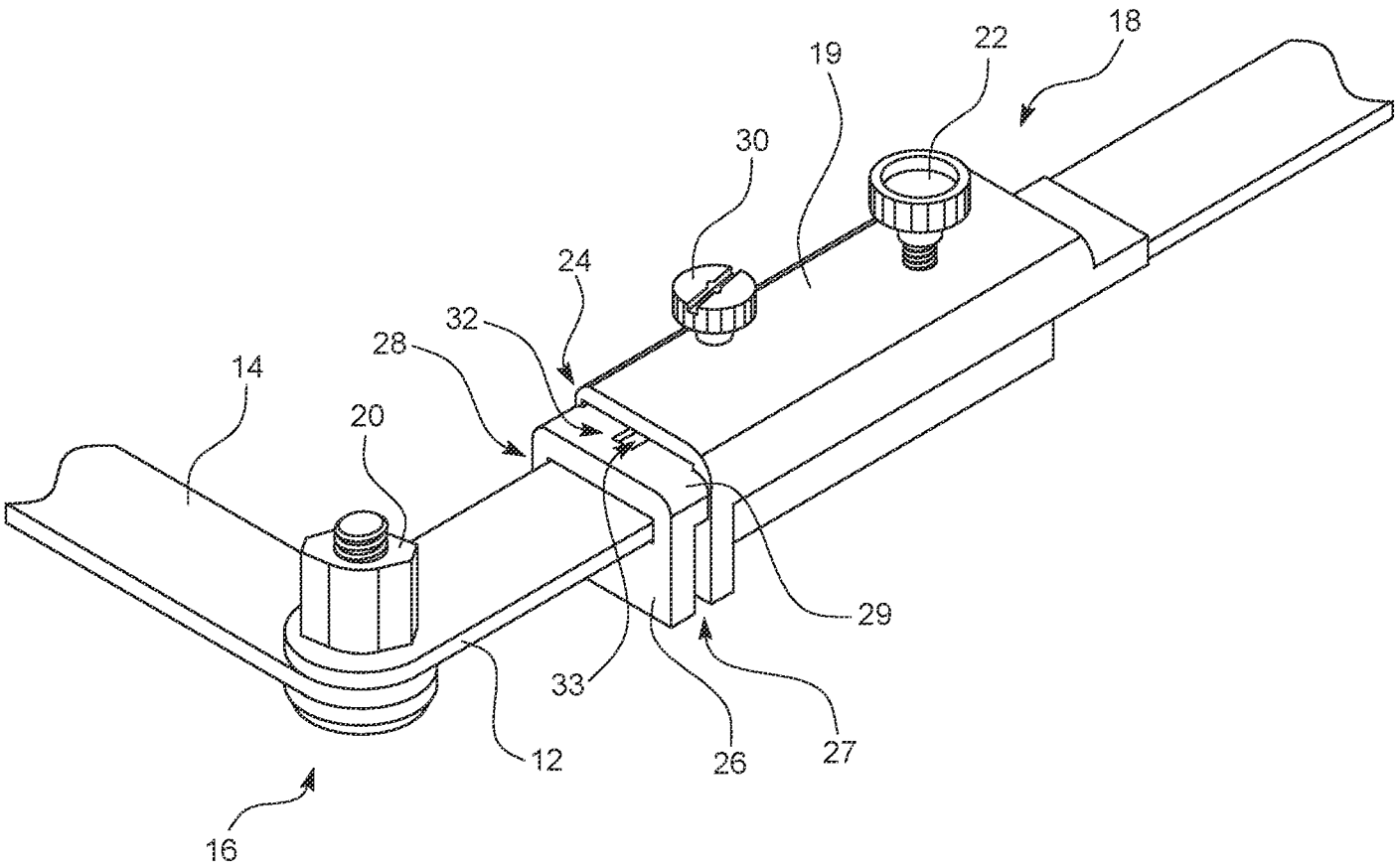
FIG. 2 provides a perspective view of, at the least, a top portion of a slide piece of the disclosed device according to an embodiment of the present disclosure.
Figure 3:
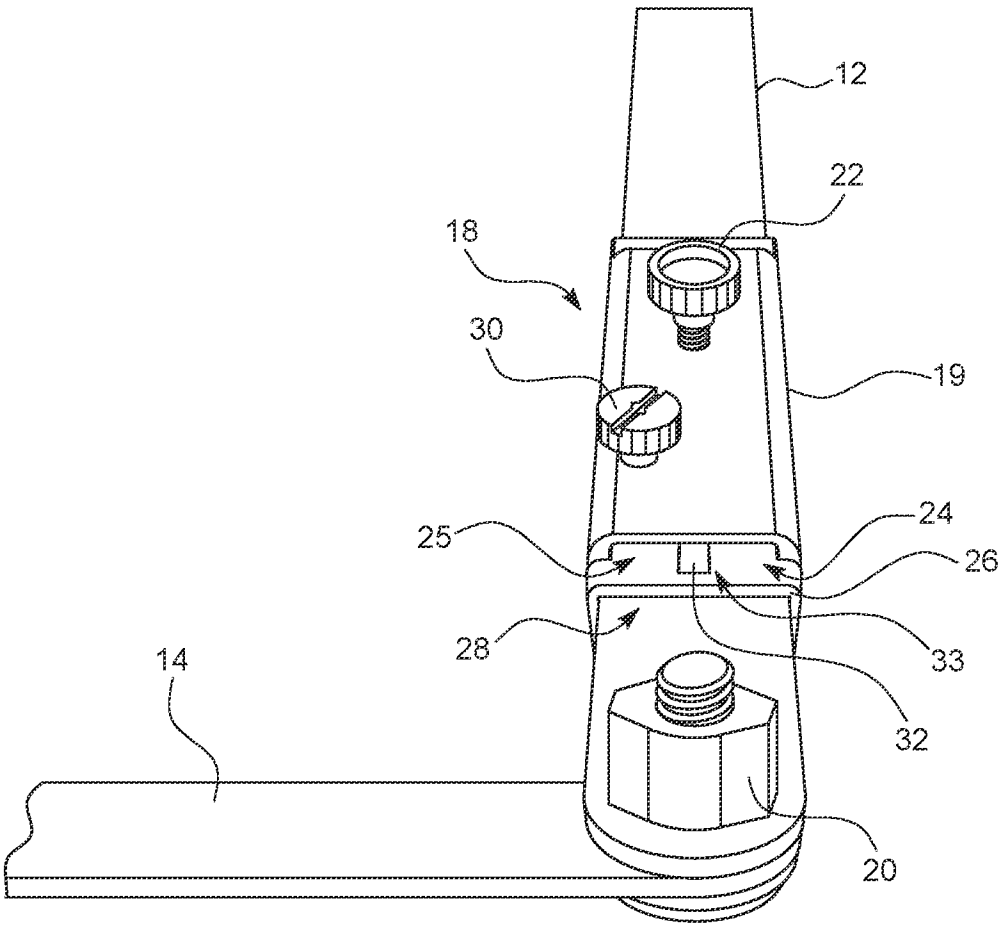
FIG. 3 provides a perspective view of, at the least, the top portion of the slide piece of the disclosed device according to an embodiment of the present disclosure.
Figure 4:
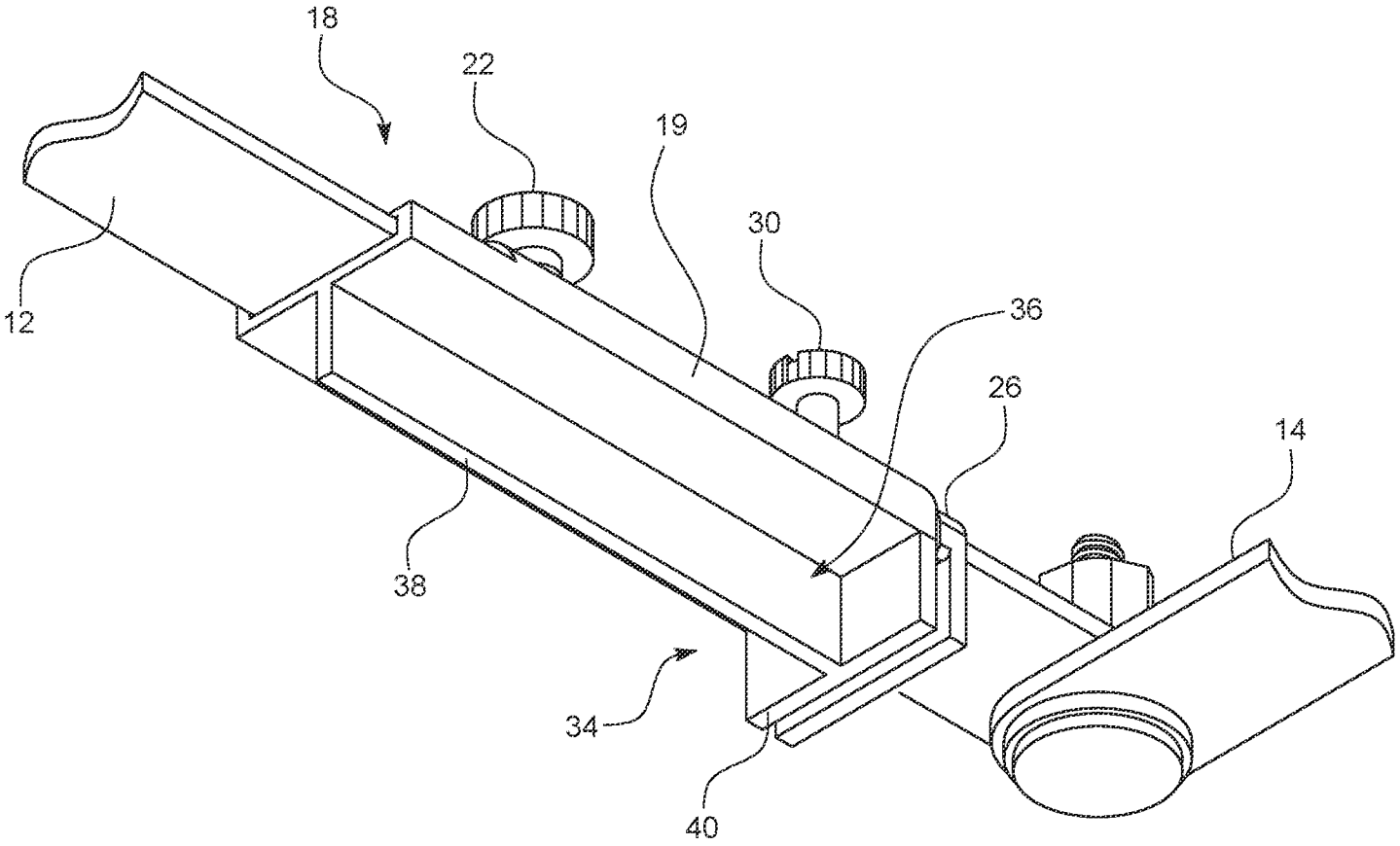
FIG. 4 provides a perspective view of, at the least, a bottom portion of the slide piece of the disclosed device according to an embodiment of the present disclosure.
Figure 5:
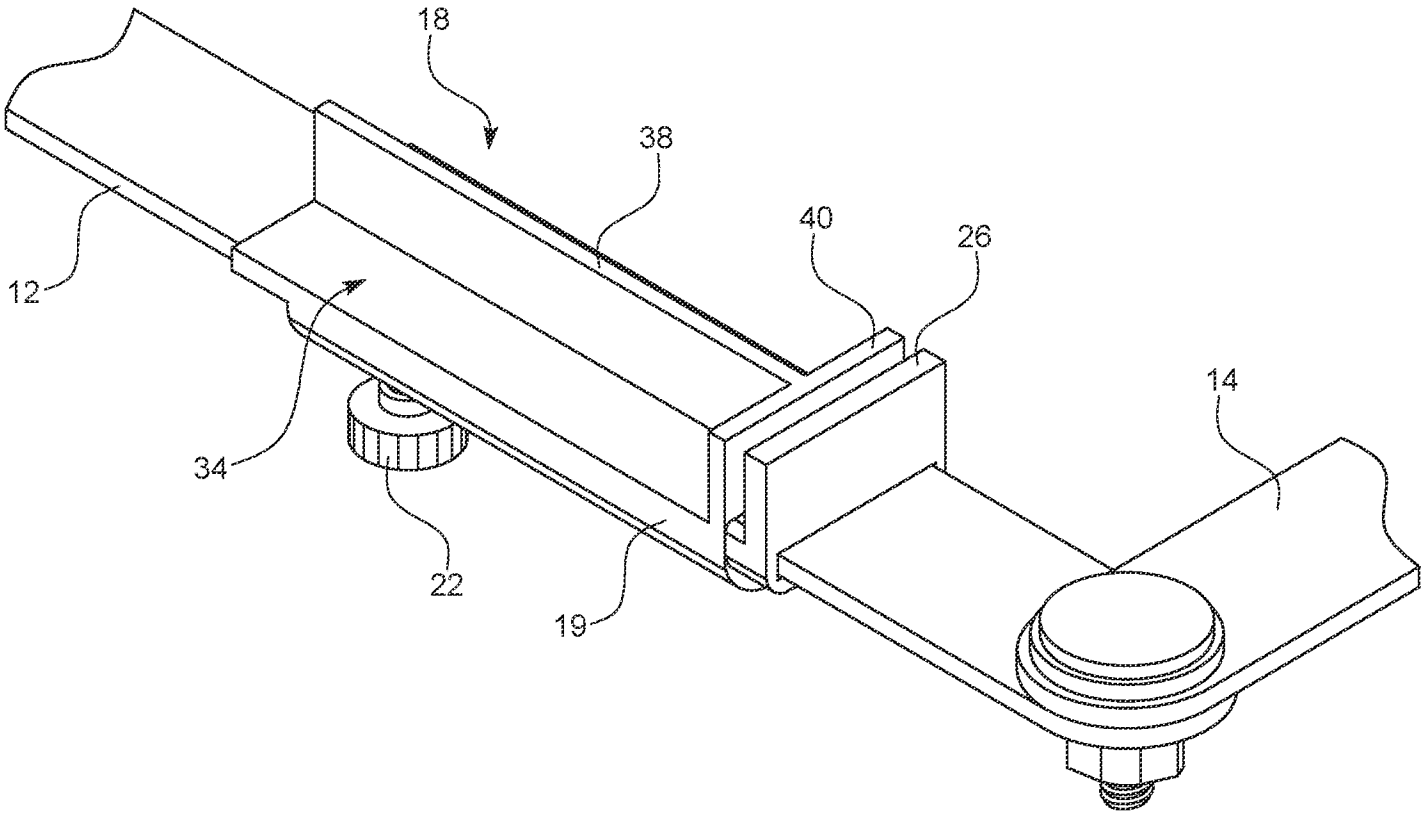
FIG. 5 provides a perspective view of, at the least, the bottom portion of the slide piece of the disclosed device according to an embodiment of the present disclosure.
Figure 6:
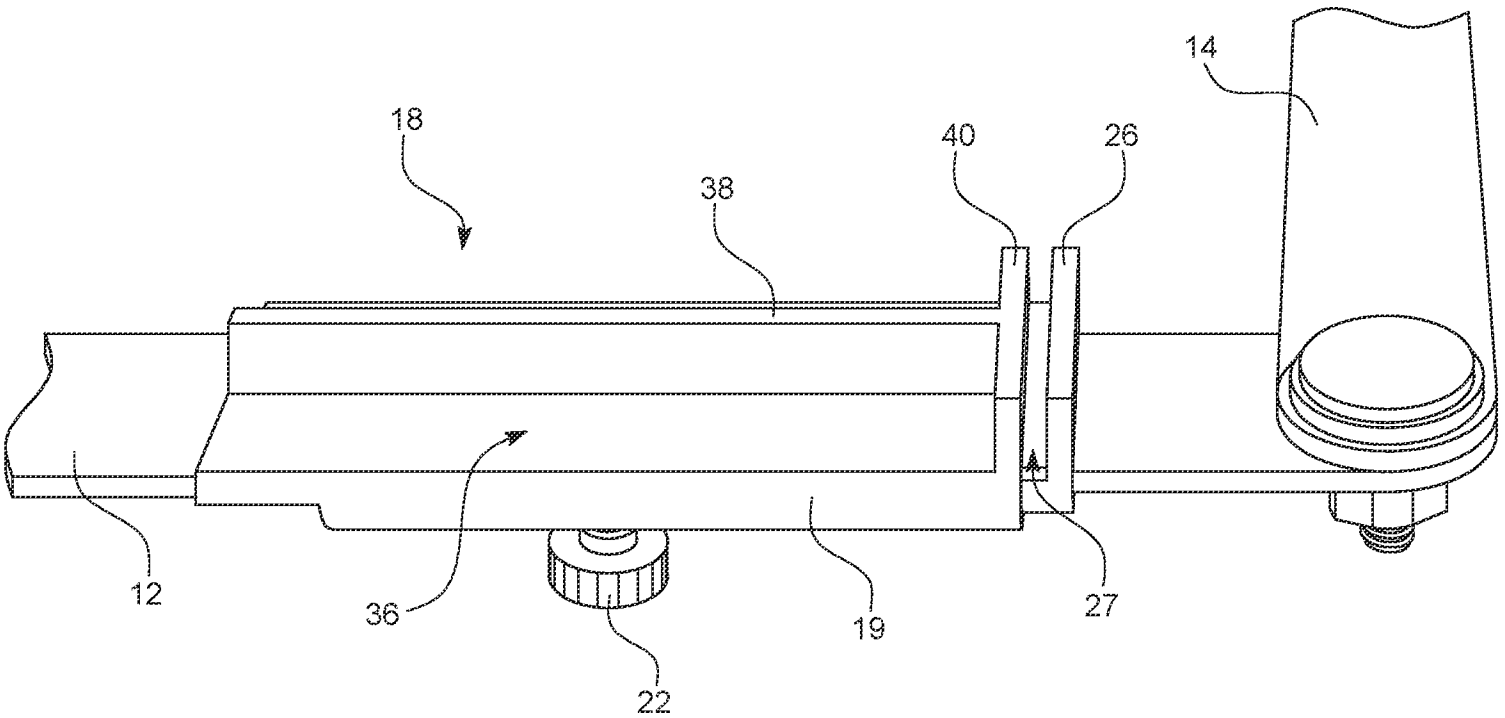
FIG. 6 provides a perspective view of, at the least, the bottom portion of the slide piece of the disclosed device according to an embodiment of the present disclosure.
Figure 7:
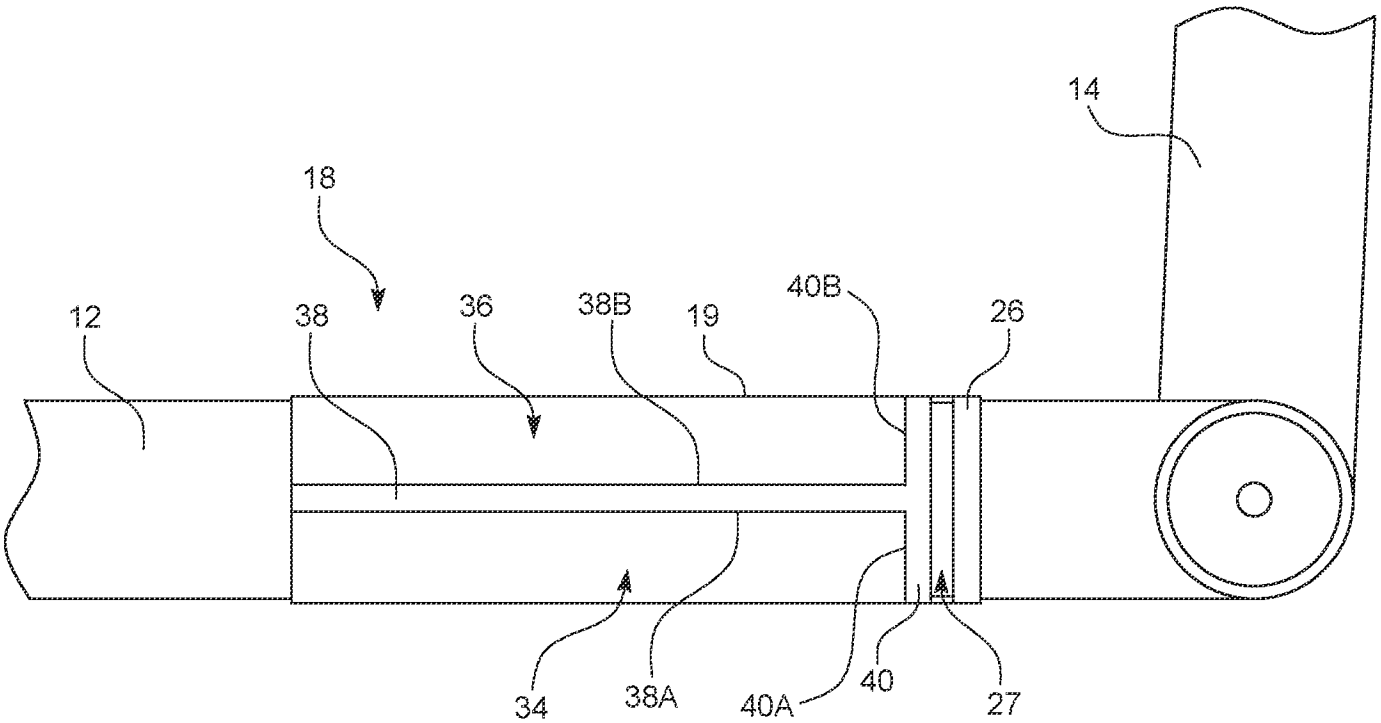
FIG. 7 provides a top-down view of, at the least, the bottom portion of the slide piece of the disclosed device according to an embodiment of the present disclosure.

FIGS. 2-7 provide close-up views of portions of the device 10, including the slide piece 18. FIGS. 2 and 3 provide perspective views of the slide piece 18, featuring in particular the top portion of the slide piece 18. FIGS. 4-6 provide perspective views of the slide piece 18, featuring in particular the bottom portion of the slide piece 18. FIG. 7 provides a top-down view of the bottom portion of the slide piece 18. The top portion of the slide piece 18 generally corresponds with the side of the slide piece 18 configured with a slide piece lock 22 and the bottom portion of the slide piece 18 generally corresponds with the side of the slide piece 18 configured with a first recess 34 and a second recess 36.

As best seen in FIGS. 2 and 3, a body 19 of the slide piece 18 defines an interior hollow 24 through which the first member 12 passes. The dimensions of the hollow 24 generally restrict movement of the slide piece 18 except lengthwise along the first member 12. Movement of the slide piece 18 along the first member 12 is selectively restricted or enabled by manipulation of a slide piece lock 22. The slide piece lock 22 is embodied as a thumbscrew for ease of use by an operator without requiring additional tools, but is not so limited. The thumbscrew is installed in a threaded bore in the top portion of the body 19 of the slide piece 18. When tightened, the thumbscrew contacts the first member 12 to inhibit movement of the slide piece 18 along the first member 12. When further tightened, the thumbscrew's contact with the first member 12 prevents movement of the slide piece 18 altogether. That is, the slide piece 18 is locked into place.

The slide piece 18 also comprises an adjustable spacer 26. The spacer 26 is configured with an opening 28 through which the first member 12 also passes. The spacer 26 may be positioned relative to the body 19 by an operator such that the dimensions of a cut tile includes an offset that allows for space for grouting between the cut tile and a vertical wall and/or between the cut tile and an adjacent installed tile. A space 27 is defined between the spacer 26 and the opposite portion of the body 19 of the slide piece 18.

A portion of the spacer 26 extends into the hollow 24 of the body 19 of the slide piece 18. An operator may define or adjust the particular grouting offset afforded by the spacer 26 by further extending the spacer 26 from the hollow 24 of the body 19 of the slide piece 18 or retracting the spacer 26 into the hollow 24 of the body 19 of the slide piece 18. The spacer 26 may be configured with a stop 29 to limit the retraction of the spacer 26 into the body 19, as well as provide a protrusion that an operator may manipulate for extension or retraction of the spacer 26. Extension or retraction of the spacer 26 is selectively restricted or enabled by manual manipulation of a spacer lock 30. The spacer lock 30 may comprise a thumbscrew installed within a threaded bore in the top portion of the body 19 of the slide piece 18. When tightened, the thumbscrew presses against the portion of the spacer 26 within the hollow 24 of the body 19 of the slide piece 18, thereby restricting movement of the spacer 26. With sufficient manipulation of the thumbscrew, the spacer 26 may be locked in place. Conversely, the thumbscrew may be loosened to again allow for the spacer 26 to be extended or retracted with respect to the hollow 24 of the body 19 of the slide piece 18. The spacer lock 30 may be laterally offset from the longitudinal axis of the slide piece 18, such as to account for a lengthwise slot going down the middle (widthwise) of the first member 12.

The spacer 26 further comprises a depressed channel 32 aligned with the longitudinal axis of the slide piece 18. The channel 32 may be laterally centered with respect to the width of the spacer 26. The channel 32 defines a longitudinal slot 33 positioned to accommodate the screw portion of the slide piece lock 22. The channel 32 and the slot 33 may correspond with the position of a longitudinal alignment element 38 (discussed below) on the bottom portion of the body 19. In particular, the internal sides of the channel 32 and/or slot 33 may correspond with the side surfaces of the longitudinal alignment element 38 such that the position of a side surfaces of the longitudinal alignment element 38 may be determined by reference to the corresponding internal side of the channel 32 and/or slot 33.

As shown in FIG. 3, the top surface of the spacer 26 may be configured with one or more rule markings 25 to guide the operator in determining the correct extension of the spacer 26 to effect a desired grouting offset. The rule markings 25 may indicate the width of the grouting offset that will result using a current extension or relative position of the spacer 26 from the body 19. Since the device 10 may account for both a grouting space between a custom-cut tile and a wall and an opposite grouting space between the custom-cut tile and the adjacent installed tile, the rule markings 25 may reflect a width that is double the desired width of the individual grouting spaces and the operator should select a rule marking 25 accordingly. Alternatively, the device 10 may be used in a situation in which a grouting space is needed only on one side of the custom-cut tile. In this case, the operator may select a rule marking 25 that directly reflects the desired width of the single grouting space.

Although not shown in FIG. 3, the rule markings 25 may each be labeled with a width value for a grouting space, such as ⅜ of an inch, ¼ of an inch, ⅛ of an inch, 1/16 of an inch, and so forth. The rule markings 25 may additionally or alternatively include rule markings for width values according to the metric system. In an embodiment (not shown), a second set of rule markings may be provided on the top of the spacer 26 opposite the shown rule markings 25. One set of rule markings 25 may be in imperial units (e.g., inches or fractions thereof) and the second opposite set of rule markings may be in metric units (e.g., millimeters). The width values indicated by the rule markings 25 may reflect common industry grouting space widths. It is emphasized that the rule markings 25 and/or labels do not directly indicate a distance between the spacer 26 and the body 19, a length that the spacer 26 is extended from the body 19, or other explicit measurement of the position of the spacer 26 relative to the body 19. The rule markings 25 rather indicate the width (or double, as the case may be) of the grouting space resulting from selection of the corresponding rule marking 25.

Additionally or alternatively, the rule markings 25 may be color-coded according to common industry standard grouting space widths. For example, an orange rule marking 25 may indicate a ¼ inch grouting space, a blue rule marking 25 may indicate a 3/16 inch grouting space, a white rule marking 25 may indicate a ⅛ inch grouting space, and a green rule marking 25 may indicate a 1/16 inch grouting space. In an embodiment, the rule markings 25 may be each double color-coded. One color coding of a rule marking 25 may indicate a width value for when the custom-cut tile is to be installed with a single grouting space and a second color-coding of the rule marking 25 may indicate a width value for when the custom-cut tile is to be installed with two opposite grouting spaces. A rule marking 25 may be labeled with two numerical width values in a similar fashion.

With particular attention to FIGS. 4-7, the bottom portion of the body 19 of the slide piece 18 comprises a longitudinal alignment element 38 and a lateral alignment element 40. The longitudinal alignment element 38 and the lateral alignment element 40 are joined in a T-formation. The longitudinal alignment element 38 is perpendicular to the lateral alignment element 40. The longitudinal alignment element 38 extends lengthwise along the longitudinal axis of the body 19 and generally laterally bisects the body 19. The longitudinal alignment element 38 extends the majority of the length of the body 19. The lateral alignment element 40 is positioned flush (e.g., co-planar) with the corresponding end of the body 19. That is, the surface of the lateral alignment element 40 facing the spacer 26 is flush (e.g., coplanar) with the end of the body 19. The lateral (with respect to the body 19) ends of the lateral alignment element 40 fully extend to the sides of the body 19. The space 27 is defined between the lateral alignment element 40 and the spacer 26.

The longitudinal alignment element 38 and the lateral alignment element 40 together define a first recess 34 and a second recess 36 opposite the first recess 34. In particular, and as best seen in FIG. 7, a first inner surface **40*a* of the lateral alignment element 40 and a first inner surface 38*a* of the longitudinal alignment element 38 define the first recess 34. Likewise, a second inner surface 40*b* of the lateral alignment element 40 and a second inner surface of the longitudinal alignment element 38 define the second recess 36. In the embodiment shown in the figures, the lateral bisection of the bottom portion of the body 19 by the longitudinal alignment element 38 defines the first recess 34 and the second recess 36. The first recess 34 and the second recess 36 may be symmetrical to one another. The first recess 34 and/or the second recess 36 are defined to accommodate a corner of a tile, particularly a corner of a tile that is already installed and being used as a point of reference to determine the cutline of the tile piece that is to be installed. For example, when a corner of a tile is positioned in the first recess 34, one side of the corner of the tile may abut the first inner surface 40***a* of the lateral alignment element 40 and a second side of the corner may abut the first inner surface 38*a* of the longitudinal alignment element 38. When an opposite corner of the tile (or other tile) is positioned in the second recess 36, one side of the opposite corner may abut the second inner surface 40*b* of the lateral alignment element 40 and a second side of the opposite corner may abut the second inner surface 38*b* of the longitudinal alignment element 38. By including the two opposite recesses, the device 10 may be used with either opposing corner of an installed tile.

Figure 8:
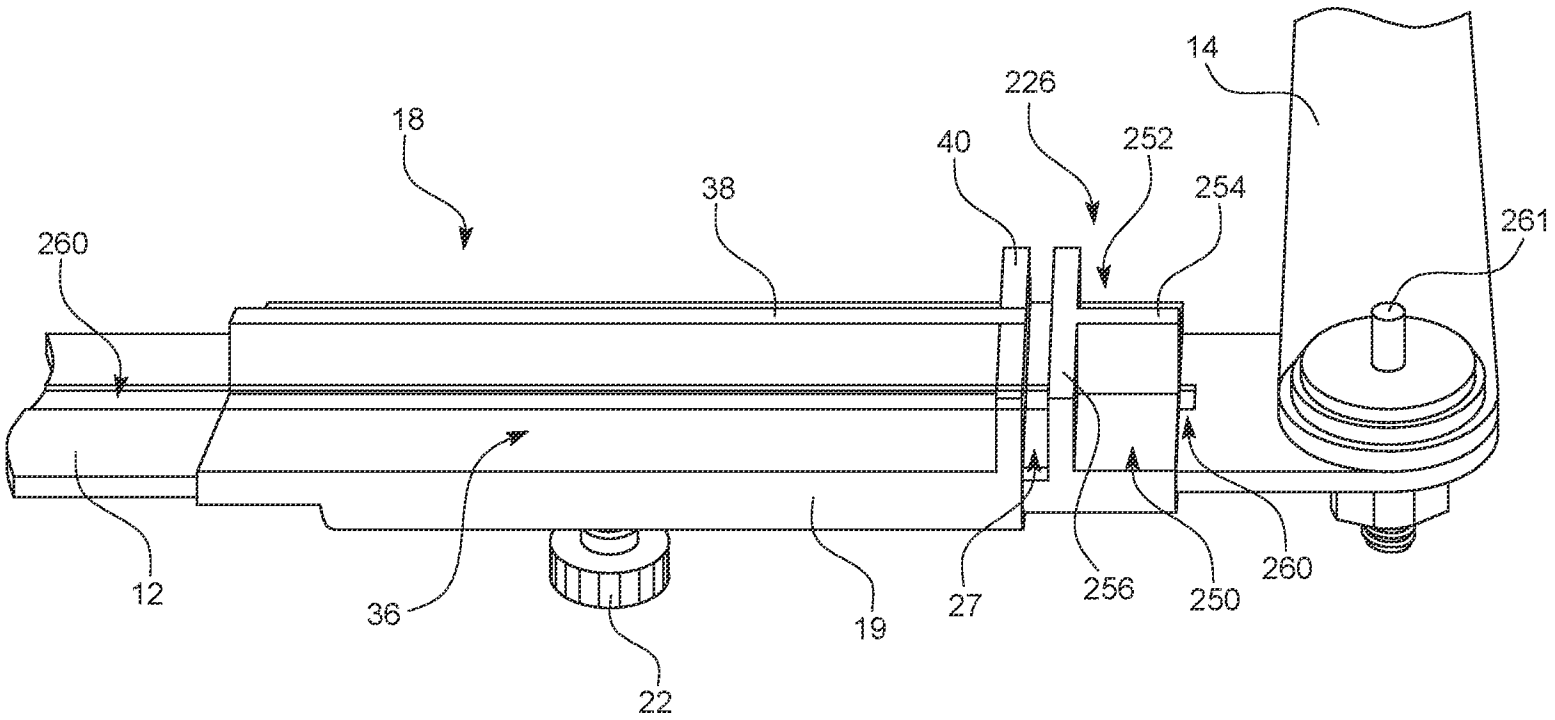
FIG. 8 provides a perspective view of, at the least, the bottom portion of the slide piece of the disclosed device according to an embodiment of the present disclosure.
Figure 9:
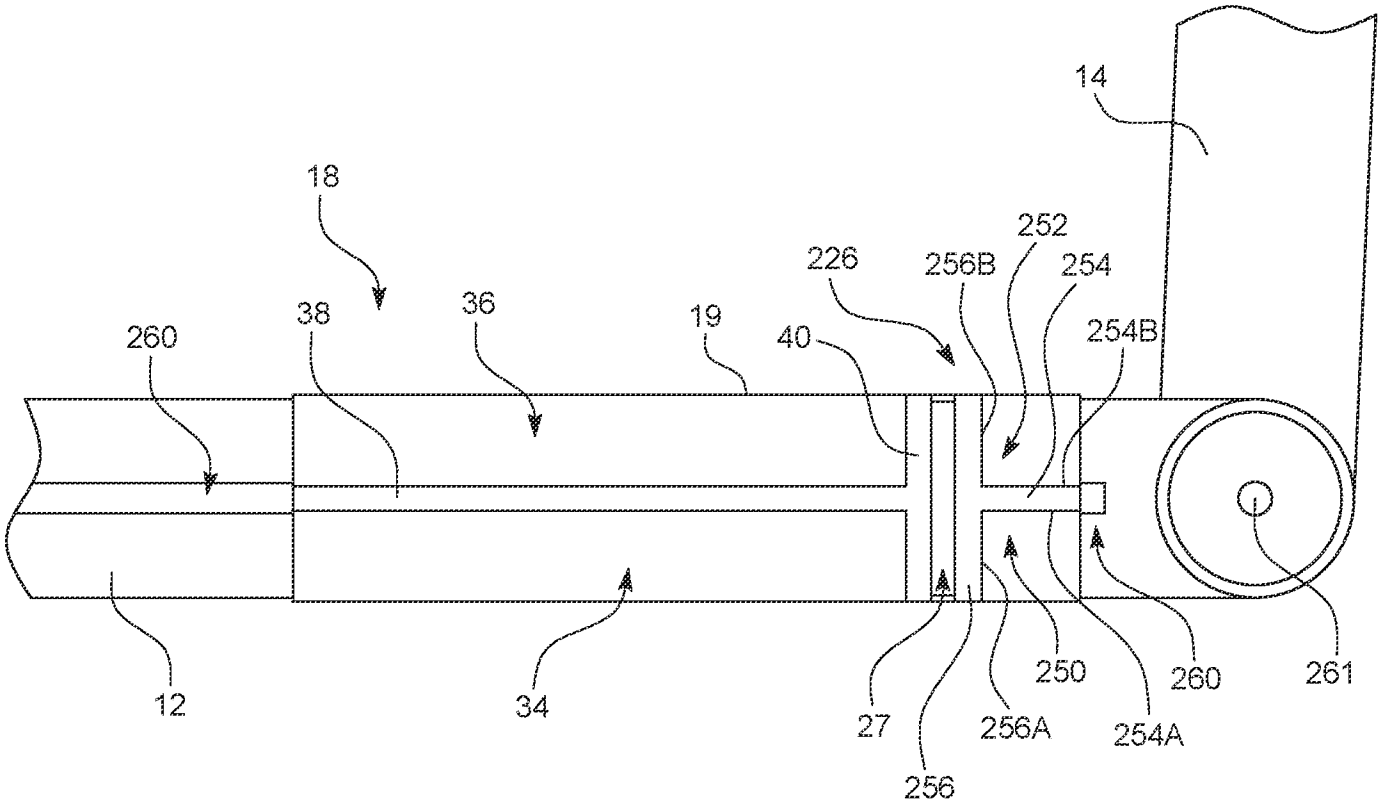
FIG. 9 provides a perspective view of, at the least, the bottom portion of the slide piece of the disclosed device according to an embodiment of the present disclosure.

FIGS. 8 and 9 provides views of the bottom portion of the device 10 according to an embodiment of the present disclosure. FIG. 8 provides a perspective view of the bottom portion of the device 10 and FIG. 9 provides a top-down view of the bottom portion of the device 10. In this embodiment of the device 10, the slide piece 18 is configured with a spacer 226. The spacer 226 is similar in numerous aspects with the spacer 26 in FIGS. 2-7, except as otherwise described. The spacer 226 is generally configured to aid in positioning the device 10 at the uncut custom tile after determining and locking in the angle between the first member 12 and the second member 14 at the angled wall. As such, the spacer 226 provides an extension of the spacer 26 towards the hinge 16. The spacer 226 likewise comprises an extension of the opening 28 of the spacer 26 through which the first member 12 passes. A portion of the first member 12 passing through the extension of the spacer 226 is shown in dotted lines in FIG. 9.

In a mirror arrangement to the longitudinal alignment element 38 and the lateral alignment element 40 of the body 19, the spacer 226 comprises a longitudinal alignment element 254 and a lateral alignment element 256. The longitudinal alignment element 254 and the lateral alignment element 256 of the spacer 226 are arranged in a T-formation, with the longitudinal alignment element 254 being perpendicular to the lateral alignment element 256. The longitudinal alignment element 254 extends along the central longitudinal axis of the slide piece 18 and aligns with the longitudinal alignment element 38 of the body 19. The sides of the longitudinal alignment element 254 and the sides of the longitudinal alignment element 38 likewise align, respectively. The first inner surface 38*a* of the longitudinal alignment element 38 (partially defining the first recess 34 in the body 19) longitudinally aligns with a first inner surface 254*a* of the longitudinal alignment element 254 of the spacer 226. Similarly, the second inner surface 38*b* of the longitudinal alignment element 38 (partially defining the second recess 36 in the body 19) longitudinally aligns with a second inner surface 254*b* of the longitudinal alignment element 254 of the spacer 226. Thus, the lateral widths of the longitudinal alignment element 38 of the body 19 and the longitudinal alignment element 254 of the spacer 226 may be equal. The lateral alignment element 40 of the body 19 and the lateral alignment element 256 of the spacer 226 are parallel to one another, with the space 27 being defined therebetween.

As noted, the first inner surface 254*a* of the longitudinal alignment element 254 and the first inner surface 256*a* of the lateral alignment element 256 define the first recess 250. The first recess 250 of the spacer 226 is configured to accept a corner of a tile, such as when positioning the device 10 at the uncut custom tile. The second inner surface 254*b* of the longitudinal alignment element 254 and the second inner surface 256*b* of the lateral alignment element 256 define the second recess 252, opposite the first recess 250. The second recess 252 is also configured to accept a corner of a tile, such as when positioning the device 10 at the uncut custom tile. A configuration having both the first recess 250 and the mirror second recess 252 provide additional flexibility in using the device 10 with either the left side or the right side of a tile. In an aspect, the spacer 226 may be a modification over the spacer 26 only insofar as the addition of the longitudinal alignment element 254, without the additional horizontal surfaces and the extension of the opening 28 shown in FIG. 8.

FIGS. 8 and 9 further show an embodiment of the device 10 in which the first member 12 and second member 14 are each configured to define one or more see-through slots 260. The slots 260 extend along the longitudinal axis of the first member 12 and second member 14 and are centered laterally in the first member 12 and second member 14, respectively. The width of the slots 260 may equal the width of the longitudinal alignment element 38 of the body 19. Although the slots 260 extend for a majority of the lengths of the first member 12 and second member 14, respectively, the disclosure is not so limited. For example, the slot 260 on the first member 12 may be broken into two or more separate, longitudinally aligned slots 260. Likewise, the slot 260 on the second member 14 may be broken into two or more separate, longitudinally aligned slots 260. In an aspect, one or more of the slots 260 may extend to the hinge 16. This may allow the first or second member 12, 14 so-configured to slide lengthwise through the hinge 16. That is, the position of the hinge 16 at the first or second member 12, 14 may be set in this manner.

The slot 260 in the first member 12 may be used to facilitate positioning the device 10 at the uncut custom tile, particularly with respect to aligning the edge of the uncut tile such that the edge aligns with the particular longitudinal inner surface (e.g., the first inner surface 38*a* or the second inner surface 38*b*) of the longitudinal alignment element 38 that was used in an initial step of determining the angle between the first member 12 and the second member 14. Since the widths of the slots 260 generally equal the width of the longitudinal alignment element 38 of the body 19, an operator may look through a slot 260 while positioning the device 10 at the uncut tile to determine that the edge of the uncut tile is flush with the edge of the slot 260. Yet it will be noted that, for purposes of illustration, the slots 260 are depicted as being slightly wider than and/or offset from the longitudinal alignment element 38 of the body 19 and longitudinal alignment element 254 of the spacer 226.

FIGS. 8 and 9 further show the hinge 16 configured with a hinge alignment element 261. The hinge alignment element 261 may vertically protrude (with respect to the horizontal plane of the first member 12 and/or the second member 14) from the hinge 16. The hinge alignment element 261 may be configured as a pin or peg. The hinge alignment element 261 may be positioned and dimensioned to longitudinally align with the longitudinal alignment element 38 and/or the longitudinal alignment element 254. The hinge alignment element 261 may have the same width as the longitudinal alignment element 38 and/or the longitudinal alignment element 254. Similarly, the hinge alignment element 261 may have the same height or vertical dimension (with respect to the horizontal plane of the first member 12 and/or the second member 14) as the longitudinal alignment element 38 and/or the longitudinal alignment element 254. Alternatively, the hinge alignment element 261 may be configured as a square or rectangular alignment element, similar in shape to the longitudinal alignment element 38 or the longitudinal alignment element 254. The hinge alignment element 261 so-configured may be affixed to the first member 12 and/or second member 14 proximate the hinge 16 rather than to the hinge 16 directly. For example, the hinge alignment element 261 may be realized in an "L" shape, with one leg of the L being attached to the first or second member 12, 14 proximate the hinge 16 and the other leg of the L extending just above the surface of the hinge 16. The hinge alignment element 261 may generally operate as an alignment stop for the device 10 when positioning the device 10 on the uncut custom tile.

Figure 10:
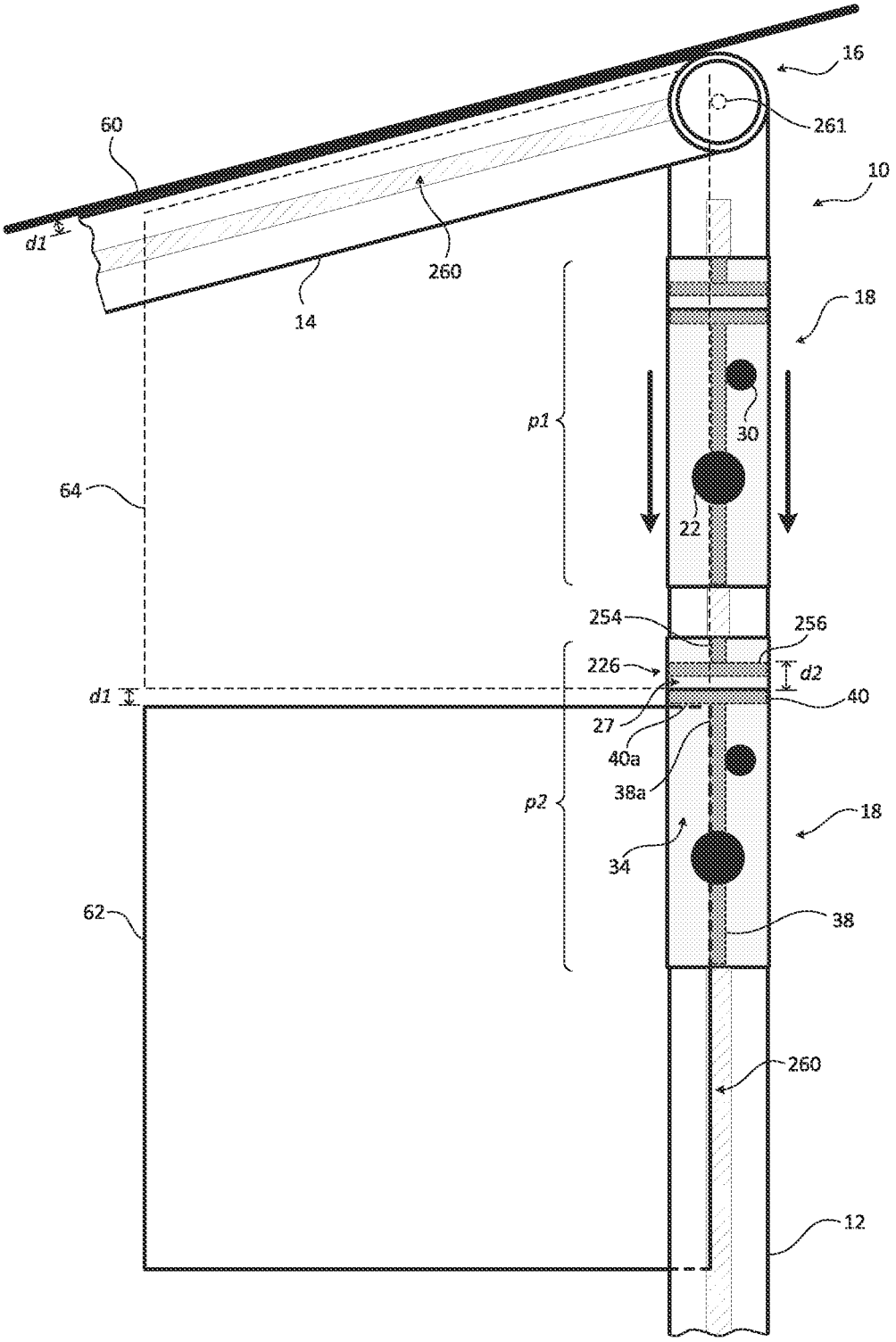
FIG. 10 provides a diagram demonstrating a use of the disclosed device according to an embodiment of the present disclosure.
Figure 11:
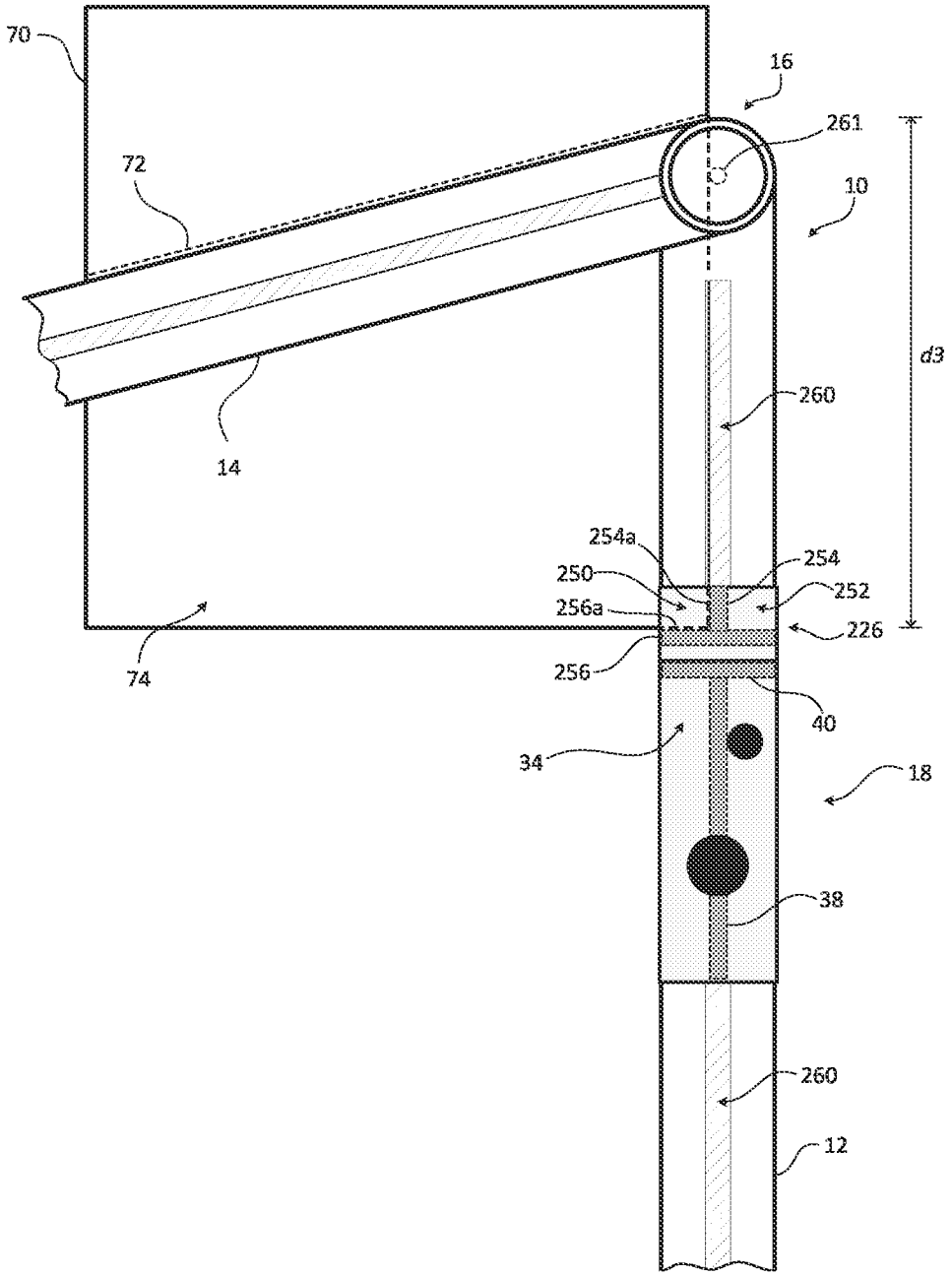
FIG. 11 provides a diagram demonstrating a further use of the disclosed device according to an embodiment of the present disclosure.

FIGS. 10 and 11 provide an illustration of the device 10 in use to determine a cutline for a tile that is to be installed between an angled wall 60 and an installed tile 62. The cutline may be defined by a cut angle and a cut dimension. In this example use case, the spacer 226 of FIGS. 8 and 9 is shown for purposes of illustration. Similar techniques may be performed using the spacer 26 of FIGS. 2-7. The device 10 shown in FIGS. 10 and 11 also comprises the first member 12 configured with a slot 260 shown in FIGS. 8 and 9. The second member 14 is also configured with a slot 260 in FIGS. 10 and 11.

The tile is to be cut to leave equal grouting spaces, the distances d1, between the cut tile and the installed tile 62 and between the cut tile and the wall 60. The spacer 226 may be configured (e.g., extended and/or retracted) for a distance d2 between a surface of the lateral alignment element 40 (facing the space 27) and a surface of the lateral alignment element 256 of the spacer 226 facing away from the space 27 and toward the hinge 16 (e.g., the first inner surface 256*a* or the second inner surface 256*b* of the lateral alignment element 256). The distance d2 may be twice the distance d1, such as when grouting is to be installed both between the cut tile and the adjacent angled wall 60 and between the cut tile and the adjacent installed tile. Alternatively, the distance d2 may equal the distance d1, such as when no grouting is to be installed between the cut tile and the adjacent angled wall 60. An operator may use the rule markings 25 shown in FIG. 3 in determining the correct extension of the spacer 226 to realize the desired grouting space width. The preferred position of the cut tile once installed is indicated in FIG. 10 by the dotted lines 64.

At the tile installation location, the wingnut 20 or other hinge tightener is loosened so that the first member 12 and the second member 14 are able to pivot freely upon manual manipulation. Likewise, the slide piece lock 22 or other movement restrictor is loosened so that the slide piece 18 is able to slide freely along the first member 12 upon manual manipulation. The slide piece 18 may be positioned along the first member 12 anywhere between the junction with the second member 14 and the installed tile 62, such as at position p1. The device 10 is held such that the top portion of the slide piece 18 comprising the slide piece lock 22 and the spacer lock 30 are facing upward. The longitudinal alignment element 38 and the lateral alignment element 40 on the bottom portion of the slide piece 18 are shown for reference by dotted lines. The longitudinal alignment element 254 and lateral alignment element 256 of the spacer 226 are likewise shown for reference by dotted lines.

The first member 12 and the second member 14 are pivoted so that the second member 14 is flush to the wall 60 and the first member 12 is parallel to the side edge of the installed tile 62. Once this positioning is established, the wingnut 20 may be tightened down until the first member 12 and the second member 14 are unable to pivot and are locked into their relative positions. The angle between the first member 12 and second member 14 should be maintained while the wingnut 20 is tightened. The angle between the first member 12 and second member 14 at this point may be considered the cut angle for the custom tile.

Next, the slide piece 18 is slid toward the installed tile 62 until, at position p2, the corner of the installed tile 62 occupies the first recess 34 and is flush with (i.e., abuts) both the lateral alignment element 40 and the longitudinal alignment element 38. That is, the slide piece 18 is positioned such that the top edge of the corner of the tile 62 is flush against the first inner surface 40*a* of the lateral alignment element 40 and the side edge of the corner of the tile 62 is flush against the first inner surface 38*a* of the longitudinal alignment element 38. This may involve some movement of the device 10 as a whole but the second member 14 should still be held flush with the wall 60 when the corner of the installed tile 62 is positioned in the first recess 34. While maintaining the position of the slide piece 18 and the device 10 in general, the slide piece lock 22 is to be tightened until the slide piece 18 is unable to move and the position of the slide piece 18 on the first member 12 is fixed.

The device 10 may be removed from the installed tile 62 and taken to a cutting station to cut the custom tile for installation. Neither the position of the slide piece 18 on the first member 12 nor the pivot angle of the first member 12 and the second member 14 should have been allowed to change in the meantime.

With reference to FIG. 11, the device 10 is positioned on the uncut tile 70 with the top portion of the slide piece 18 facing upward. The device 10 is positioned longitudinally such that the bottom of the corner of the tile 70 abuts the spacer 226. Specifically, the device is positioned such that the corner of the tile 70 occupies the first recess 250 of the spacer 226, with the bottom of the corner of the tile 70 abutting the first inner surface 256*a* of the lateral alignment element 256 and the side of the corner of the tile 70 abutting the first inner surface 254*a* of the longitudinal alignment element 254. The distance between the lateral alignment element 256 of the spacer (i.e., the first inner surface 256*a*) and the distal end of the first member 12 at the hinge 16 may be considered a cut dimension to create the custom tile. The cut dimension is marked as distance d3 in FIG. 11. The hinge alignment element 261 may be also used to guide the correct positioning of the device 10 at the tile 70. The device 10 may be positioned so that the hinge alignment element 261 abuts against the side edge of the tile 70, thereby helping to prevent any rotational misalignment of the device 10 relative to the tile 70, specifically to the side edge of the tile 70.

More generally, the device 10 is positioned laterally such that the side of the tile 70 is aligned with the inner surface 38*a* of the longitudinal alignment element 38 that defines the first recess 34. Since the width and lateral positioning of the slots 260 in the first member 12 correspond with the longitudinal alignment element 38, an operator may use the slots 260 as a visual or tactile guide in laterally positioning the device 10. For example, the operator may position the device 10 so that the side edge of the tile 70 aligns with and is flush with the left side edge of the slot 260. With respect to the longitudinal position of the device 10 on the tile 70, the lateral alignment element 256 (and/or the spacer 26) may serve as a stop such that the correct longitudinal position of the device 10 is determined when the bottom of the tile 70 abuts the lateral alignment element 256 (and/or the spacer 26). It is again noted that the slots 260 are shown in FIGS. 10 and 11 as wider than and/or offset from the longitudinal alignment element 38 of the body 19 and/or the longitudinal alignment element 254 of the spacer 226 for purposes of illustration.

Additionally or alternatively, an operator may use the channel 32 (and/or slot 33) in the spacer 226 (or the spacer 26) as a point of reference in positioning the device 10 at the tile 70. This may be performed by aligning the side of the tile 70 with the corresponding side of the channel 32 (and/or slot 33). It will be recalled that an interior side of the channel 32 and/or slot 33 may correspond (e.g., align) with the respective side of the longitudinal alignment element 38. The interior sides of the channel 32 and/or slot 33 may be used as a visual or tactile point of reference for the sides of the longitudinal alignment element 38.

Once the device 10 and the tile 70 are secured in this position, a cutline 72 is made using the top straight edge (that was previously flush with the wall 60) of the second member 14. The top straight edge of the second member 14 may comprise the edge of the second member 14 distal from the bottom edge of the tile 70. The second member 14 may be sized such that the cutline 72 fully spans the tile 70. If the second member 14 is not of sufficient length, a partial cutline may be initially marked and then fully extended to create the complete cutline 72. The tile 70 may be cut along the cutline 72 to create the cut tile 74. The cut tile 74 may be installed in the anticipated space (indicated by the dotted line 64 in FIG. 10) between the wall 60 and the installed tile 62. Preferably, the cut tile 74 is installed equidistant from the wall 60 and the installed tile 62 to define equal grouting spaces between the wall 60 and the cut tile 74 and between the cut tile 74 and the installed tile 62.

It will be appreciated that the device 10 may be used on either side of the installed tile 62 by virtue of the first recess 34 and the opposite second recess 36 of the body 19 of the slide piece 18, as well as the first recess 250 and the second recess 252 of the spacer 226 if the device 10 is so configured. This may be advantageous when the position within the workspace of the installed tile 62 and/or cut tile 74 prevents use of the device 10 on one side of the tile. For example, that side of the tile may be adjacent a second wall. Rather than position the device 10 at the right side (from the perspective of FIG. 10) of the installed tile 62, the device 10 may be positioned at the left side of the installed tile 62. In this case, instead of moving the slide piece 18 such that the right corner of the installed tile 62 occupies the first recess 34, the slide piece 18 may be moved toward the installed tile 62 such that the left corner of the installed tile 62 occupies the second recess 36 in the bottom portion of the slide piece 18. Even though the first member 12 and the second member 14 will be pivoted to an obtuse angle, rather than the acute angle shown in FIGS. 8 and 9, the cutline 72 may be determined in a similar manner.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

Recitation of ranges of values herein are merely intended to serve as a shorthand method of referring individually to each separate value falling within the range, unless otherwise indicated herein, and each separate value is incorporated into the specification as if it were individually recited herein.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

It will be apparent to those skilled in the art that various modifications and variations may be made without departing from the scope or spirit. Other embodiments will be apparent to those skilled in the art from consideration of the specification and practice disclosed herein. It is intended that the specification and examples be considered as exemplary only, with a true scope and spirit being indicated by the following claims.

What is claimed is:

1. A device comprising:

an elongated first member;

an elongated second member pivotally coupled to the first member via a hinge, wherein the hinge is configured to selectively prevent or enable pivoting of the first member and the second member at the hinge; and a slide piece slidingly coupled to the first member, wherein the slide piece is configured to selectively prevent or enable movement of the slide piece lengthwise along the first member, wherein the slide piece comprises:

a body comprising a first longitudinal alignment element that is parallel to a longitudinal axis of the body and a first lateral alignment element arranged perpendicular to the first longitudinal alignment element, wherein the first longitudinal alignment element and the first lateral alignment element together define a first recess at a bottom portion of the slide piece, the first recess being configured to receive a corner of a tile, and a spacer comprising a second lateral alignment element parallel to the first lateral alignment element of the body, wherein the spacer is configured to selectively extend from and retract into the body and the first lateral alignment element and the second lateral alignment element define a space therebetween when the spacer is at least partially extended from the body.

2. The device of claim 1, wherein:

the spacer comprises a second longitudinal alignment element longitudinally aligned with the first longitudinal alignment element of the body, the second longitudinal alignment element being perpendicular to the second lateral alignment element of the spacer, and the second longitudinal alignment element and the second lateral alignment element together define a second recess at the bottom portion of the slide piece, the second recess being configured to receive a corner of a tile.

3. The device of claim 2, wherein:

the first longitudinal alignment element of the body and the first lateral alignment element of the body together define a third recess, laterally opposite the first recess, at the bottom portion of the slide piece and configured to receive a corner of a tile, and the second longitudinal alignment element of the spacer and the second lateral alignment element of the spacer together define a fourth recess, laterally opposite the second recess, at the bottom portion of the slide piece and configured to receive a corner of a tile.

4. The device of claim 1, wherein the first member comprises a slot elongated along the longitudinal axis of the first member.

5. The device of claim 4, wherein a lateral dimension of the slot corresponds to a lateral dimension of the first longitudinal alignment element of the body.

6. The device of claim 1, wherein the spacer is configured with one or more markings each reflecting a measure of extension of the spacer from the body.

7. The device of claim 6, wherein the one or more markings each indicate a grouting space width that will result from use of the device with the spacer positioned at the measure of extension corresponding to the respective marking.

8. The device of claim 7, wherein the one or more markings are each color-coded according to the indicated grouting space width.

9. The device of claim 1, wherein a width of the spacer with respect to the longitudinal axis of the slide piece and a width of the space with respect to the longitudinal axis of the slide piece together define a grouting space width resulting from use of the device.

10. The device of claim 1, wherein the body and the spacer each comprise a hollow, wherein the first member passes through the hollow of the body and the hollow of the spacer.

11. The device of claim 1, wherein the body comprises a screw configured to apply pressure, upon operation of the screw, to the first member to prevent movement of the slide piece lengthwise along the first member.

12. The device of claim 1, wherein the body comprises a screw configured to apply pressure, upon operation of the screw, to the spacer to prevent extension and retraction of the spacer.

13. A method of using the device of claim 1 to determine a cut angle and a cut dimension for an uncut custom tile that is to be installed between an installed tile and a fixed vertical surface oriented at an irregular angle with respect to the installed tile, the method comprising:

positioning the second member to abut the fixed vertical surface;

positioning the first member parallel to a side edge of the installed tile;

while the second member abuts the fixed vertical surface and the first member is parallel to the side edge of the installed tile:

operating the hinge to prevent the first member and the second member from pivoting relative to one another, wherein an angle between the first member and the second member comprises the cut angle; and positioning the device and the slide piece such that a corner of the installed tile, defined in part by the side edge of the installed tile, occupies the first recess and abuts both the first longitudinal alignment element of the body and the first lateral alignment element of the body, wherein the cut dimension for the custom tile comprises a distance between the second lateral alignment element of the spacer and a distal end of the first member at the hinge.

14. The method of claim 13, further comprising:

operating the slide piece to prevent the slide piece's movement along the first member;

positioning the device at the uncut custom tile such that the second member overlaps a side edge of the uncut custom tile and the spacer abuts a bottom edge of the uncut custom tile; and creating a cutline on the uncut custom tile using a top edge of the second member, wherein the top edge of the second member is distal the bottom edge of the uncut custom tile.

15. The method of claim 14, further comprising:

positioning the device at the uncut custom tile such that the side edge of the uncut custom tile is longitudinally aligned with a side surface of the first longitudinal alignment element defining the first recess.

16. The method of claim 15, wherein the first member comprises a slot elongated along the longitudinal axis of the first member, the method further comprising:

positioning the device at the uncut custom tile such that a side edge of the slot is longitudinally aligned with the side edge of the uncut custom tile.

17. The method of claim 15, wherein the spacer comprises a second longitudinal alignment element longitudinally aligned with the first longitudinal alignment element of the body, the second longitudinal alignment element being perpendicular to the second lateral alignment element of the spacer, and wherein the second longitudinal alignment element and the second lateral alignment element together define a second recess at the bottom portion of the slide piece, the second recess being configured to receive a corner of a tile, the method further comprising:

positioning the device at the uncut custom tile such that a corner of the uncut custom tile, defined by the bottom edge of the uncut custom tile and the side edge of the uncut custom tile, occupies the second recess, the side edge of the uncut custom tile abuts the second longitudinal alignment element of the spacer, and the bottom edge of the uncut custom tile abuts the second lateral alignment element of the spacer.

18. The method of claim 13, further comprising:

positioning the spacer to extend from or retract into the body, wherein the position of the spacer relative to the body defines at least one of a resultant grouting space width between the installed tile and the custom tile once installed or a resultant grouting space width between the fixed vertical surface and the custom tile once installed.

19. The method of claim 18, wherein the spacer is positioned relative to the body according to one or more markings on the spacer.

20. The method of claim 19, wherein the one or more markings are color-coded according to a resultant grouting space width.

* * * * *